United States Patent [19]

Runge

[11] Patent Number: 4,808,141

[45] Date of Patent: Feb. 28, 1989

[54] TOY CAR & BALLOON

[75] Inventor: Marvin Runge, Speedway, Ind.

[73] Assignee: Zoom Balloons Corporation, Speedway, Ind.

[21] Appl. No.: 169,620

[22] Filed: Mar. 18, 1988

[51] Int. Cl.[4] ..... A63H 3/06

[52] U.S. Cl. ..... 446/222; D21/84

[58] Field of Search ..... 446/220, 221, 222, 465, 446/484, 485; D21/84, 128, 135

[56] References Cited

U.S. PATENT DOCUMENTS

| | | | |
|---|---|---|---|
| D. 225,761 | 1/1973 | Munn et al. | 446/465 |
| 1,471,886 | 10/1923 | Dessau | 446/220 |
| 1,745,576 | 2/1930 | Kempien | 446/220 |
| 4,438,588 | 3/1984 | Martin | 446/222 |
| 4,551,109 | 11/1985 | Hanson | 446/465 |

*Primary Examiner*—Robert A. Hafer
*Assistant Examiner*—Michael Brown
*Attorney, Agent, or Firm*—Barnes & Thornburg

[57] ABSTRACT

The invention relates to a balloon containing a toy vehicle inside the balloon, with the wheels of the vehicle running on the inner surface of the balloon when the balloon is inflated. The vehicle is designed in such a manner that its body portion cannot touch the inner surface of the inflated balloon, or interfere with its wheels riding on that inner surface.

11 Claims, 1 Drawing Sheet

TOY CAR & BALLOON

I. BACKGROUND AND SUMMARY OF THE INVENTION

The present invention pertains generally to toys and similar devices and particularly to such devices comprising a hollow article such as a ball or balloon which includes an object to be controlled or manipulated by movement of the article.

It is known to construct toys or other similar devices in the form of hollow articles such as balls, balloons, and the like, and to include within such articles other objects for the purpose of making noise or presenting a colorful pattern through motion induced by manipulation of the hollow article. Such toys are of particular use with small children where the objects included within the hollow article are of such a size as to present an invitation to ingestion and, as a result, a clear hazard to the child. The articles may take the form of opaque, translucent or transparent spheres, cylinders, ovoids, or the like. The objects within the articles in the prior art typically have been balls, cubes, or other simple geometrically shaped devices, or shapes representing familiar articles such as animals, faces, etc.

In accordance with the present invention, a hollow article is formed to include a four-wheeled toy vehicle specifically designed to run on the inner surface of the hollow article. The toy vehicle includes four wheels, generally arranged in pairs so that an inner surface of each wheel confronts a similar inner surface of a laterally adjacent wheel. A body means maintains the spacial and directional relationship of the four wheels with respect to each other either directly or by defining the relative position of a pair of axles on which the four wheels are mounted. The body means is preferably dimensioned such that its center of gravity is centrally located between the four wheels. The body means is dimensioned to be wholly included with a spacial envelope defined by lines joining the outer peripheries of the four wheels.

In a particularly advantageous embodiment of the invention, an inflatable balloon is provided with a toy vehicle as generally described above. The toy vehicle is constructed from a generally rectangular sheet consisting of two leaf portions joined by a fold. Two axles are provided, each axle having two wheels, one wheel being located at each end of each axle. A central portion of the two axles are captured between the two leaf portions in spaced relation to each other and in a generally parallel relation to the fold. Means such as an adhesive is provided to secure the two leaf portions together fixing the relative position of the two axles while permitting free rotation of the wheels.

Preferably the size of the toy vehicle is larger than the opening of the balloon through the balloon inflated. This relative sizing requires that the opening of the balloon be stretched to insert the toy vehicle in position within the balloon. This relative sizing diminishes the likelihood that the toy vehicle might be accidentally ingested during the inflation of the balloon. Once the balloon is inflated, it is preferable that the balloon have a radius which is several times the length of the toy vehicle to permit the desired action of the toy vehicle within the balloon. While the preferred environment of the toy vehicle of the present invention is that of a balloon, any hollow article might be employed which had a generally smooth interior surface upon which the wheels of the toy vehicle might roll.

II. BRIEF DESCRIPTION OF THE DRAWINGS

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

III. DESCRIPTION OF THE PREFERRED EMBODIMENT

Figure 1:
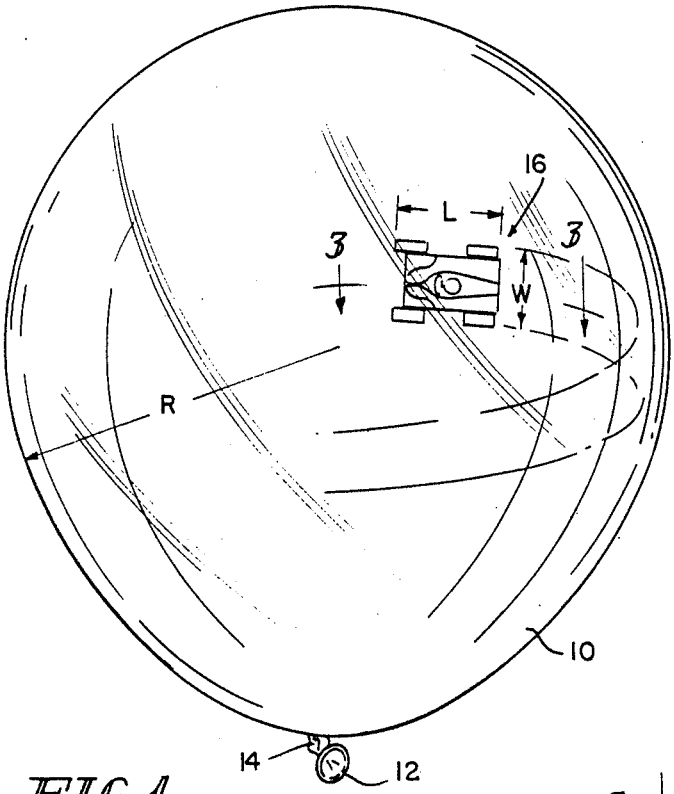
FIG. 1 is a perspective view of an inflated balloon containing a toy car.

A balloon 10 as illustrated in FIG. 1 in an inflated condition having a ovoid, nearly spherical configuration of radius R. The balloon 10 includes an opening 12 through which air or gas can be introduced or withdrawn. A securing means 14 such as a clamp or knot is provided to prevent the passage of air or gas through opening 12.

Within the balloon 10 is a toy car 16. The toy car 16 has a lateral or width dimension W which is illustrated to be greater than the diameter of opening 12 and a length dimension L greater than the width W. The relationship between the smaller of the dimensions L and W, and the size of the opening 12 is selected such that the opening 12 must be stretched in order to initially introduce the toy car 16 within the balloon 10. Once the toy car 16 is positioned within the balloon 10, the balloon 10 may be inflated and deflated at will without fear of the toy car 16 being expelled through the opening 12. When the balloon 10 is inflated, as shown in FIG. 1, the radius R of the balloon 10 is larger than the length L of the car 16. Desirably, the radius R of the inflated balloon 10 is several times the length L of car 16 but the exact dimensional relationship between R and L is not critical.

Figure 2:
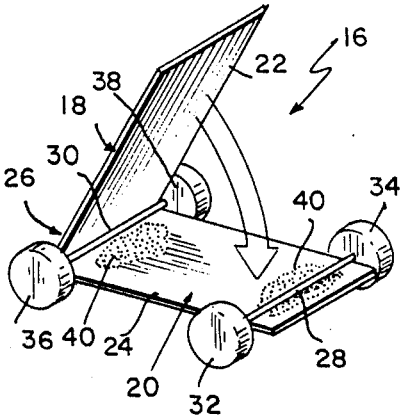
FIG. 2 is a perspective view of a toy car during assembly.

FIG. 2 illustrates a particularly advantageous method of constructing a toy car 16 in accordance with the present invention. The car 16 includes a body 18 formed from a generally rectangular sheet 20 including an upper leaf 22 and a lower leaf 24 joined by a fold 26. A pair of axles 28 and 30 have wheels 32–38 rotatably mounted at the ends of the axles 28 and 30. A central portion of the axles 28 and 30 between the wheels 32–38 are captured between the upper leaf 22 and lower leaves 24 of sheet 20 as the leaves are closed in the direction of the arrow shown in FIG. 2. Means such as an adhesive 40 is provided to secure the leaves 22, 24 and axles 28, 30 together, yet continue to permit the rotation of the wheels 32–38 relative to the body 18 thus formed.

Figure 3:
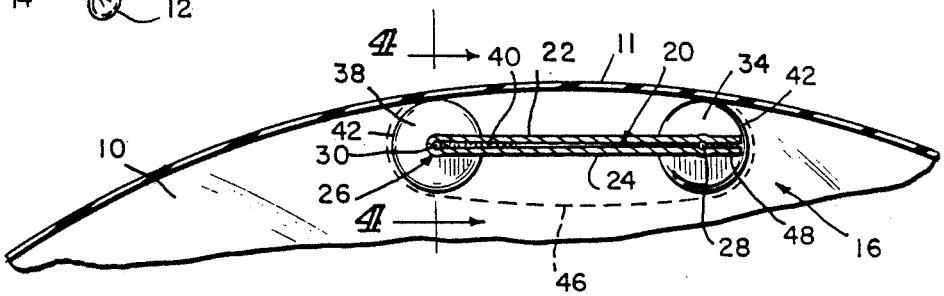
FIG. 3 is a sectional view of the car and balloon shown in FIG. 1 taken along lines 3—3.
Figure 4:
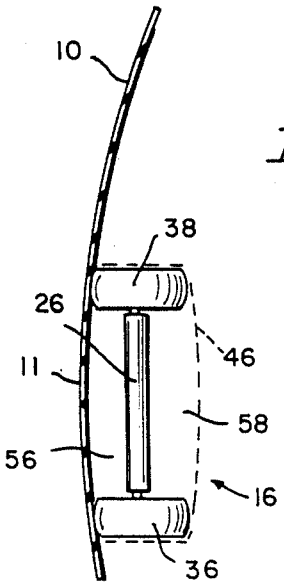
FIG. 4 is a sectional view taken along lines 4—4 of FIG. 3.
Figure 5:
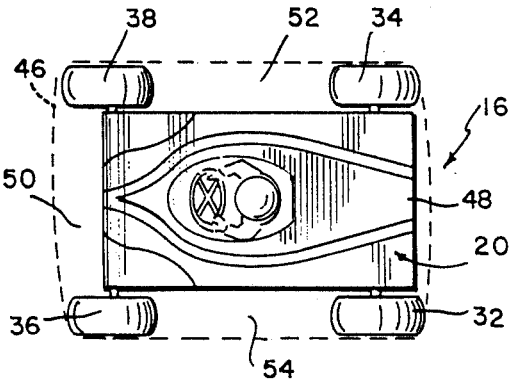
FIG. 5 is a plan view of a toy car constructed in accordance with the present invention.

FIGS. 3, 4, and 5 illustrate a critical feature of the toy vehicle of the present invention if it is to be employed within a hollow article as intended in the present invention. FIG. 3 shows only a small portion of balloon 10 or a similar hollow article broken away and sectioned through the length of toy car 16. The fold 26 joining the upper leaf 22 and lower leaf 24 can be seen to be positioned immediately adjacent to axle, there being no substantial portion of the body 20 of the toy vehicle 16 protruding to the left of fold 26. Looking at the opposite end of the toy vehicle, it can be seen that both upper leaf 22 and lower leaf 24 project to the right of axle 28 approximately to the outer periphery 42 of wheel 34.

While the body 20 is shown in FIG. 3 to be substantially planar, such configuration is, within limited herein described, merely for ease of construction and not related to performance. Nevertheless, there are some performance related limitations on the body 20. Upon examination of the wall 11 of the balloon 10 between wheels 34 and 38 it will be recognized that the balloon 10 is generally arcuate in shape and tangent to the peripheries 42 of wheels 34 and 38. A dotted line 46 is shown in FIG. 3 which defines an envelope surrounding wheels 34 and 38, and by inference also wheels 32 and 36, within which wall 11 of the balloon 10 does not project (assuming no discontinuities on the interior surface of the ballon 10). This same envelope 46 can be provided across the toy car 16 as shown in FIG. 4. It will be seen that the envelope 46 surrounds the car 16 as shown in FIG. 5.

Upon consideration of the envelope 46, it will be apparent that the body 20 of the car 16 may be extended from the illustrated shape to include any portion of the region within envelope 46 without substantially changing the ability of the car 16 to move within the balloon 10. That is, FIGS. 3 and 5 show that the right end of the car 16 protrudes beyond axle 28 toward the periphery 42 of wheels 32 and 34. In like manner, the left end of the toy car 16 could be extended into space 50 as shown in FIG. 5 between fold 26 and envelope 46. Likewise, the body 20 of toy vehicle 16 could be extended laterally between the wheels into spaces 52 and 54 inside envelope 46 as shown in FIG. 5. Finally, the body 20 of the vehicle 16 could be extended into spaces 56 and 58 within envelope 46 as shown in FIG. 4.

In order that the toy vehicle 16 might always be capable of moving within the balloon 10 on the four wheels 32–38, the body 20 must be confined within the envelope 46 defined by a surface joining the outer peripheries of the four wheels 32–38. It will be appreciated that the toy vehicle 16 can be appropriately decorated as shown in FIG. 5 to simulate a race car or other vehicle and thereby contribute to a pleasing appearance and encourage manipulation of the toy vehicle 16 within the balloon 10 by movement of the balloon 10.

While the present invention has been described in connection with an inflatable balloon 10, it will be appreciated that the toy vehicle 16 at the present invention could be employed in any hollow article. Other variations and modifications can exist within the scope and spirit of the invention as described and as defined in the following claims.

What is claimed is:

1. A balloon containing a toy vehicle, the toy vehicle comprising a body and a plurality of wheels, the body wholly contained within an envelope area circumscribed by a plurality of straight line segments between the wheels and having ends which are tangent to outer peripheries of the wheels and by the periphery of the wheels between the tangent line segments.

2. The balloon containing a toy vehicle of claim 1 wherein the body dimension and weight are selected such that vehicle center of gravity is situated centrally between the wheels.

3. The balloon and toy vehicle of claim 1 wherein the balloon is generally spherical having a radius greater than the greatest length dimension of the toy vehicle body.

4. The balloon and toy vehicle of claim 1 wherein the balloon is at least partially transparent to permit observation of movement of the toy vehicle within the balloon.

5. The balloon and toy vehicle of claim 1 wherein the balloon includes an opening for entry and exit of gas, the vehicle being sized to prevent ejectment through the opening during exit of gas.

6. The balloon containing a toy vehicle of claim 1 wherein the toy vehicle has a pair of axles, each axle supporting a pair of adjacent wheels, the axles being fixed to the body in spaced parallel relationship to each other.

7. The balloon containing a toy vehicle of claim 6 wherein the body comprises a generally planar member joining the two axles.

8. The balloon containing a toy vehicle of claim 3 wherein the planar member has lateral edge boundaries confined within inner surfaces of the wheels.

9. The balloon containing a toy vehicle of claim 6 wherein the body comprises a sheet member including a pair of leaf portions separated by a fold, the fold defining an edge of the body means parallel to the axles.

10. The balloon containing a toy vehicle of claim 9 wherein the two leaf portions of the sheet member lie on opposite sides of a central portion of the two axles.

11. The balloon containing a toy vehicle of claim 10 further comprising adhesive means joining the two leaf portions and two axles.

* * * * *

UNITED STATES PATENT AND TRADEMARK OFFICE

CERTIFICATE OF CORRECTION

PATENT NO. : 4,808,141

DATED : February 28, 1989

INVENTOR(S) : Marvin Runge

It is certified that error appears in the above-identified patent and that said Letters Patent is hereby corrected as shown below:

At column 1, line 40, please delete "with" and insert therefor --within--;

At column 3, line 9, please delete "limited" and insert therefor --limits--; and At column 4, line 38, please delete "3" and insert therefor --7--.

Signed and Sealed this

Twelfth Day of September, 1989

*Attest:*

*Attesting Officer*

DONALD J. QUIGG

*Commissioner of Patents and Trademarks*